US011084997B2

(12) United States Patent
Price et al.

(10) Patent No.: US 11,084,997 B2
(45) Date of Patent: Aug. 10, 2021

(54) PROCESS FOR PREPARING A DIESEL FUEL COMPOSITION

(71) Applicant: SHELL OIL COMPANY, Houston, TX (US)

(72) Inventors: Richard John Price, Chester (GB); Matthias Mundt, Hamburg (DE); Roger Francis Cracknell, Manchester (GB); Eri Ito, Amsterdam (NL); Marcello Stefano Rigutto, Amsterdam (NL); Aldo Caiazzo, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 150 days.

(21) Appl. No.: 15/774,191

(22) PCT Filed: Nov. 10, 2016

(86) PCT No.: PCT/EP2016/077344

§ 371 (c)(1),
(2) Date: May 7, 2018

(87) PCT Pub. No.: WO2017/081199

PCT Pub. Date: May 18, 2017

(65) Prior Publication Data

US 2018/0327680 A1 Nov. 15, 2018

(30) Foreign Application Priority Data

Nov. 11, 2015 (EP) ..... 15194098

(51) Int. Cl.
*C10L 1/08* (2006.01)

(52) U.S. Cl.
CPC ..... *C10L 1/08* (2013.01); *C10L 2200/0446* (2013.01); *C10L 2200/0492* (2013.01); *C10L 2230/22* (2013.01); *C10L 2270/026* (2013.01); *C10L 2300/30* (2013.01)

(58) Field of Classification Search
CPC ..... C10L 1/08; C10L 2200/0446; C10L 2200/0492; C10L 2230/22; C10L 2270/026; C10L 2300/30
See application file for complete search history.

(56) References Cited

U.S. PATENT DOCUMENTS

| | | | | |
|---|---|---|---|---|
| 4,208,190 | A | 6/1980 | Malec | |
| 5,349,188 | A | 9/1994 | Maggard | |
| 5,378,348 | A | 1/1995 | Davis et al. | |
| 5,490,864 | A | 2/1996 | Herbstman | |
| 5,766,274 | A | 6/1998 | Wittenbrink et al. | |
| 5,888,376 | A | 3/1999 | Wittenbrink et al. | |
| 6,204,426 | B1 | 3/2001 | Miller et al. | |
| 7,345,210 | B2 * | 3/2008 | Maund | C10L 1/08 585/14 |
| 7,638,661 | B2 * | 12/2009 | Davenport | C10L 1/026 585/14 |
| 7,867,377 | B2 * | 1/2011 | Clark | C10L 1/08 208/15 |
| 2007/0012636 | A1 * | 1/2007 | Wisnoski | A47F 5/0846 211/70.6 |
| 2007/0265479 | A1 * | 11/2007 | Landschof | C10L 1/08 585/14 |
| 2012/0010112 | A1 | 1/2012 | Grabarse et al. | |
| 2012/0102826 | A1 | 5/2012 | Fang | |
| 2015/0021232 | A1 * | 1/2015 | Clark | C10L 1/08 208/15 |

FOREIGN PATENT DOCUMENTS

| | | | |
|---|---|---|---|
| CN | 1714138 | A | 12/2005 |
| CN | 101273116 | A | 9/2008 |
| CN | 105026527 | A | 11/2015 |
| EP | 0149240 | A2 | 7/1985 |
| EP | 0482253 | A1 | 4/1992 |
| EP | 0583836 | A1 | 2/1994 |
| EP | 0613938 | A1 | 9/1994 |
| EP | 0557516 | B1 | 7/1996 |
| EP | 1013744 | A1 | 6/2000 |
| EP | 1101813 | A1 | 5/2001 |
| GB | 960493 | A | 6/1964 |
| WO | 9533805 | A1 | 12/1995 |

(Continued)

OTHER PUBLICATIONS

Upgrading of Fischer Tropsch Produce Diesel Dieter LeckelConference Paper (42 pages) Aug. 2010 (Year: 2010).*

Dependence of Fuel Properties During Blending of loParaffinic Keroene and Petrleum Derived Jet fuel by R Striebich, L Shafer, M DeWitt and Z West Unviverity Dayton Research Institue Nov. 2008 (72 pages) (Year: 2008).*

Distillation Curve Optimization Using Monotonic Interpolation Nov. 17, 2014 Menezes BC Petrobras Kelly J D Grossmann (Year: 2014).*

(Continued)

*Primary Examiner* — Pamela H Weiss

(74) *Attorney, Agent, or Firm* — Shell Oil Company

(57) ABSTRACT

Process for preparing a diesel fuel composition comprising the steps of:

(i) blending a Fischer-Tropsch derived gasoil with a petroleum derived gasoil to form a blended gasoil which is compliant with the EN590 specification, wherein the Fischer-Tropsch derived gasoil has a density of 0.8 g/cm$^3$ or less and wherein the petroleum derived gasoil is derived from naphthenic high density petroleum crude oil and has a density at 15° C. of 0.84 g/cm$^3$ or greater and a naphthenics content of 30 wt % or greater; and (ii) mixing the blended gasoil produced in step (i) with a diesel base fuel to form a diesel fuel composition, wherein the diesel fuel composition has a density at 15° C. in the range from 0.820 g/cm$^3$ to 0.845 g/cm$^3$.

7 Claims, No Drawings

(56) References Cited

FOREIGN PATENT DOCUMENTS

| | | | |
|---|---|---|---|
| WO | 9603397 | A1 | 2/1996 |
| WO | 9714768 | A1 | 4/1997 |
| WO | 9714769 | A1 | 4/1997 |
| WO | 9932584 | A1 | 7/1997 |
| WO | 9801516 | A1 | 1/1998 |
| WO | 9842808 | A1 | 10/1998 |
| WO | 0011116 | A1 | 3/2000 |
| WO | 0011117 | A1 | 3/2000 |
| WO | 0020534 | A1 | 4/2000 |
| WO | 0020535 | A1 | 4/2000 |
| WO | 0183406 | A2 | 11/2001 |
| WO | 0183641 | A2 | 11/2001 |
| WO | 0183647 | A2 | 11/2001 |
| WO | 0183648 | A2 | 11/2001 |
| WO | 2004104142 | A1 | 12/2004 |
| WO | 2006135881 | A2 | 12/2006 |
| WO | 2007104709 | A1 | 9/2007 |
| WO | 2007110448 | A1 | 10/2007 |
| WO | 2008135602 | A2 | 11/2008 |
| WO | 2011095819 | A1 | 8/2011 |
| WO | 2011110860 | A1 | 9/2011 |
| WO | 2011149799 | A1 | 12/2011 |
| WO | 2015007694 | A1 | 1/2015 |

OTHER PUBLICATIONS

Chevron Diesel Fuels Technical Review (Jun. 2007). (Year: 2007).*

Van Der Burgt et al., "The Shell Middle Distillate Synthesis Process", 5th Synfuels Worldwide Symposium, Washington, D.C., Nov. 11-13, 1985, 15 pages.

International Search Report and Written Opinion received for PCT Patent Application No. PCT/EP2016/077344, dated Jan. 4, 2017, 9 pages.

Wei et al., "The Lubricity of Diesel Fuels", Wear, vol. 111, Issue No. 2, Sep. 1, 1986, pp. 217-235.

* cited by examiner

PROCESS FOR PREPARING A DIESEL FUEL COMPOSITION

PRIORITY CLAIM

The present application is the National Stage (§ 371) of International Application No. PCT/EP2016/077344, filed 10 Nov. 2016, which claims priority from European Application No. 15194098.8, filed 11 Nov. 2015 incorporated herein by reference.

FIELD OF THE INVENTION

The present invention relates to a process for preparing a diesel fuel composition.

BACKGROUND OF THE INVENTION

Gasoils prepared by the Fischer-Tropsch process are well known in the art. An example of a Fischer-Tropsch based process is the SMDS (Shell Middle Distillate Synthesis) described in "The Shell Middle Distillate Synthesis Process", van der Burgt et al (paper delivered at the 5$^{th}$ Synfuels Worldwide Symposium, Washington D.C., November 1985; see also the November 1989 publication of the same title from Shell International Petroleum Company Ltd., London, UK). This process (also sometimes referred to as the Shell "Gas-to-Liquids" or "GTL" technology) produces middle distillate range products by conversion of a natural gas (primarily methane) derived synthesis gas into a heavy long-chain hydrocarbon (paraffin) wax which can then be hydroconverted and fractionated to produce liquid transport fuels such as the gasoils useable in diesel fuel compositions. A version of the SMDS process, utilising a fixed-bed reactor for the catalytic conversion step, is currently in use in Bintulu, Malaysia and Pearl, Qatar, and its products have been blended with petroleum derived gasoils in commercially available automotive fuels.

By virtue of the Fischer-Tropsch process, a Fischer-Tropsch derived gasoil has essentially no, or undetectable levels of, sulphur and nitrogen. Further, the Fischer-Tropsch process as usually operated produces no or virtually no aromatic components.

An ongoing challenge however with using GTL gasoil as a component in diesel fuel is that it has a low density, typically around 0.78 g/ml, which means that it tends to lower the density of any final fuel blend. Moreover, because of this the neat GTL fuel is not compliant with the prevailing diesel specifications, such as EN590 and the like.

Naphthenic blending components may be derived from so-called naphthenic crude sources, for example by hydrotreating gasoil from naphthenic high density crude such as West African (WAF) crude or by hydrogenation of light cycle oils as obtained in a catalytic cracking process. Gasoils produced from naphthenic crudes tend to have high densities, however, which may lie outside those required by certain diesel specifications, such as EN590. Maximum density limits of international diesel qualities are currently set in order to meet diesel car emissions requirements. Density limits are to allow fuel energy flow to be controlled. In the EU, the maximum specification for density of diesel fuels in EN590 is 845 kg/m$^3$.

The consequence of these fuel requirements is that middle distillate fuels produced from naphthenic crudes may not be suitable to meet the severe environmental specification requirements being set for diesel. This will result in "off-spec" diesel fuel compositions if such naphthenic derived gasoils are used in high levels.

It has now surprisingly been found by the present inventors that if Fischer-Tropsch derived gasoil is combined with gasoil derived from high density naphthenic crude a gasoil blend is produced which has properties, such as power and fuel economy benefits, that are highly beneficial for differentiated diesel fuels and which meets the requirements of diesel specifications such as EN590. Such an "on-spec" gasoil blend which is itself EN590 compliant is much easier to transport and can advantageously be blended with EN590 diesel base fuels in particular markets to provide a diesel fuel composition.

WO2004/104142 teaches a process to prepare a kerosene and a gasoil product from a crude petroleum source having a Watson characterization factor K value of equal or below 12.0 by (a) isolation of a petroleum derived kerosene fraction and a petroleum derived gasoil fraction from said crude petroleum source, wherein the petroleum derived kerosene fraction has a smoke point of below 25 mm or below 19 mm if naphthalenes content of the kerosene fraction is below 3% vol and the petroleum derived gasoil has a cetane number of below 50 or a density higher than 845 kg/m$^3$, (b) adding a Fischer-Tropsch derived kerosene fraction to the petroleum derived kerosene fraction in an amount sufficient to obtain a mixture having a smoke point value of above 25 mm or above 19 mm if the naphthalenes content of the mixture is below 3% vol. and (c) adding a Fischer-Tropsch derived gasoil fraction to the petroleum derived gasoil fraction such that the resultant mixture has a cetane number value of above 51. Table 4 of WO2004/104142 discloses a blend of gasoil from Naphthenic crude with Fischer-Tropsch gasoil containing 34% wt. of Fischer-Tropsch derived components in the blend. However, this blend is not further blended with a diesel base fuel.

WO2007/104709 discloses a fuel composition comprising a hydrocarbon blend having a cetane number of at least 62, a kinematic viscosity at 40° C. of greater than 3.0 cSt (mm$^2$/s) and a density at 15° C. of greater than 830 kg/m$^3$, wherein the fuel composition comprises (b) a paraffinic fuel boiling in the gasoil range comprising more than 90 wt % paraffins and having a cetane number of between 70 and 85 in combination with (a) a mineral derived gasoil having a density at 15° C. of between 800 and 860 kg/m$^3$ and a kinematic viscosity at 40° C. of between 1.5 and 15 cSt (mm$^2$/s) and/or (c) a naphthenic rich blending component boiling in the gasoil range having a density at 15° C. of greater than 860 kg/m$^3$ and having a pour point of below −30° C. Table 2 of WO2007/104709 discloses diesel fuel blends comprising a mineral gasoil component, Fischer-Tropsch derived fuel and a naphthenic blending component. The napthenic blending component is present in the diesel fuel blends at a level of 41 vol % or less based on the combined volume % of Fischer-Tropsch derived fuel and the naphthenic blending component. There is no disclosure in WO2007/104709 of a process of preparing a diesel fuel composition which comprises, as a first step, the preparation of a gasoil blend which is itself EN590 compliant.

SUMMARY OF THE INVENTION

According to the present invention there is provided a process for preparing a diesel fuel composition comprising the steps of:

(i) blending a Fischer-Tropsch derived gasoil with a petroleum derived gasoil to form a blended gasoil which is compliant with the EN590 specification, wherein the Fischer-Tropsch derived gasoil has a density of 0.8 g/cm$^3$ or less and wherein the petroleum derived gasoil is derived from naphthenic high density petroleum crude oil and has a density of 0.84 g/cm$^3$ or greater and a naphthenics content of 30 wt % or greater; and (ii) mixing the blended gasoil produced in step (i) with a diesel base fuel to form a diesel fuel composition, wherein the diesel fuel composition has a density in the range from 0.820 g/cm3 to 0.845 g/cm3.

The diesel fuel composition produced by the process of the present invention has the advantage that it meets the prevailing diesel specification EN590 and has enhanced characteristics as compared to the original diesel base fuel. Further, the blend of the two gasoils produced in step (i) of the process of the present invention itself meets the EN590 specification and so can be labelled as automotive gasoil in its own right for regulatory purposes before it is blended in step (ii) with a diesel base fuel. This means that it is much easier to transport the gasoil blend produced in step (i) before it is blended in step (ii) with so-called "exchange EN590 diesel base fuels" in particular markets.

Further, the whole distribution process is greatly simplified since the "on-spec" gasoil blend produced in step (i) which is EN590 compliant can simply be mixed with EN590 diesel base fuels in any ratio with the advantage that properties such as cetane, density, viscosity and the like follow a monotonic blending rule.

DETAILED DESCRIPTION OF THE INVENTION

In order to assist with the understanding of the invention several terms are defined herein.

The term "exchange EN590 diesel base fuels" is defined by reference to the following explanation. It is common in many markets for a fuel retailer to procure base diesel from a nearby refinery under a so-called "exchange" agreement. This base diesel may then be augmented by the addition of performance additives before being sold. Nevertheless the base diesel must comply with EN590 and is sometimes known as "exchange EN590 diesel".

The term "naphthenics" as used herein means cycloparaffinic components. For the purposes described herein the terms "naphthenic" and "cycloparaffinic" may be used interchangeably. The "naphthenics content" of the petroleum-derived gasoil which is derived from naphthenic high density petroleum crude can be measured using any known test method, such as a multidimensional chromatographic technique.

In a first step of the process of the present invention a Fischer-Tropsch gasoil is blended with a petroleum derived base oil.

The Fischer-Tropsch gasoil may for example be derived from natural gas, natural gas liquids, petroleum or shale oil, petroleum or shale oil processing residues, coal or biomass.

The amount of Fischer-Tropsch derived gasoil fuel used in the diesel fuel composition herein may be from 0.1% to 80% v of the overall diesel fuel composition, preferably from 5% v to 60% v, more preferably from 10% v to 50% v, based on the diesel fuel composition.

Such a Fischer-Tropsch derived gasoil is any fraction of the middle distillate fuel range boiling in the gasoil range, which can be isolated from the (optionally hydrocracked) Fischer-Tropsch synthesis product. Examples of Fischer-Tropsch derived gasoils are described in EP-A-0583836, WO-A-97/14768, WO-A-97/14769, WO-A-00/11116, WO-A-00/11117, WO-A-01/83406, WO-A-01/83648, WO-A-01/83647, WO-A-01/83641, WO-A-00/20535, WO-A-00/20534, EP-A-1101813, U.S. Pat. Nos. 5,766,274, 5,378,348, 5,888,376 and 6,204,426.

Suitably, the Fischer-Tropsch derived gasoil will consist of at least 90, more preferably at least 95 wt % iso and normal paraffins. The weight ratio of iso-paraffins to normal paraffins will suitably be greater than 0.3. This ratio may be up to 12. Suitably this ratio is between 2 and 6. The actual value for this ratio will be determined, in part, by the hydroconversion process used to prepare the Fischer-Tropsch derived gasoil from the Fischer-Tropsch synthesis product. Some cycloparaffins may be present.

Suitably the Fischer-Tropsch derived gasoil comprises less than 1 wt % aromatics. The content of sulphur and nitrogen will be very low and normally below the detection limits for such compounds. For this reason the sulphur content of a diesel fuel composition containing a Fischer-Tropsch product may be very low.

The Fischer-Tropsch gasoil used in the present invention has a density of 0.8 g/cm$^3$ or less, preferably from 0.76 to 0.79 g/cm$^3$ at 15° C. The Fischer-Tropsch gasoil preferably has a viscosity at 40° C. of from 2.5 to 4.0 mm$^2$/s.

The petroleum derived gasoil for use herein is derived from naphthenic high density petroleum crude oil and has a density of 0.84 g/cm$^3$ or greater and a naphthenics content of 30 wt % or greater.

Preferably, the petroleum derived gasoil for use herein has a density of 0.85 g/cm$^3$ or greater, more preferably 0.86 g/cm$^3$ or greater.

Preferably, the petroleum derived gasoil has a naphthenics content of 40 wt % or greater, more preferably 50 wt % or greater, as measured by a multidimensional chromatographic technique.

The naphthenic high density petroleum crude from which the petroleum derived gasoil is derived generally contains a higher combined amount of naphthenic and aromatic components compared with the paraffins content. Generally, the higher combined amount of naphthenic and aromatic components compared with paraffinic components in the naphthenic high density petroleum crude means that the gasoil derived therefrom has a high density, of the order of 0.84 g/cm$^3$ or higher at 15° C., preferably 0.85 g/cm$^3$ or higher, more preferably 0.86 g/cm$^3$ or higher.

In a preferred embodiment herein, the naphthenic high density petroleum crude oil is a West African (WAF) crude oil, for example Forcados, Nigerian Light, Cabinda, Bonny Medium, and the like. Further information on different types of petroleum crude oils can be found on the Energy Institute website at http://www.oil-transport.info/crudedata/crudeoil-data/crudeoildata.html.

From the naphthenic high density petroleum crude oil source a petroleum derived gasoil is isolated, preferably by distillation. Such distillation is preferably carried out in an atmospheric distillation column by well known processes for the person skilled in refinery operations. The fractions isolated by distillation and which have not been subjected to another conversion process are referred to as virgin distillate fractions.

The petroleum derived gasoil fraction should preferably have an ASTM D 86 IBP of between 250 and 300° C. and a FBP of between 340 and 380° C.

In step (i) of the process of the present invention, the Fischer-Tropsch derived gasoil is blended with the petroleum derived gasoil to form a blended gasoil which in itself meets the requirements of the EN590 specification and so can be labelled as an automotive gasoil for regulatory purposes before it is then blended with diesel base fuel in step (ii) of the process of the present invention.

In one embodiment, the time between step (i) and step (ii) in the process of the present invention can be zero hours or a few minutes, i.e. the blended gasoil produced in step (i) can be blended immediately or practically immediately with a diesel base fuel in step (ii). Alternatively, the time between step (i) and step (ii) in the process of the present invention can be several hours, days or weeks depending on when the final diesel fuel composition is needed and where the different blending steps are carried out.

Blending can either be performed by so-called in-line blending, on-line blending or batch blending. This depends on the level of automation. In batch blending the petroleum-derived gasoil and the Fischer-Tropsch derived gasoil are blended to form a blended gasoil. The blended gasoil is in itself EN590 compliant so that it can be supplied to a storage vessel and then supplied to a ship, railcar or truck road tanker or other means of transport to the location where process step (ii) takes place.

When in-line blending is being applied no intermediate storage vessel is being applied between steps (i) and (ii) of the process of the present invention and the final diesel fuel formulations are directly discharged into the ship, railcar or truck road tanker. The measurement and control of the quality or property of the blend in line can be performed by well known techniques, for example near Infrared (NIR).

In step (i) of the process of the present invention, the Fischer-Tropsch derived gasoil is blended with the petroleum derived gasoil in any ratio as long as the resulting blended gas oil is compliant with the EN590 specification. Preferably in step (i) the Fischer-Tropsch derived gasoil is blended with the petroleum derived gas oil in such a ratio that the resulting blended gasoil has a density of from 830 to 845 kg/m$^3$ at 15° C. Further, it is preferred that the Fischer-Tropsch derived gasoil is blended with the petroleum derived gasoil in such a ratio that the kinematic viscosity of the resulting blended gasoil at 40° C. is at least 3 mm$^2$/s and at most 4.5 mm$^2$/s. Preferably in step (i) the Fischer-Tropsch gasoil is blended with the petroleum derived gasoil in a volume ratio of from 1:10 to 10:1, more preferably in a volume ratio of from 1:5 to 5:1, even more preferably in a volume ratio of 1:2 to 2:1, most preferably in a volume ratio of 1:1.5 to 1.5:1 and especially in a volume ratio of 1:1.5 to 1:1, more especially from 1:1.3 to 1:1.

Further, in the process of the present invention the Fischer-Tropsch derived gasoil is preferably present in the blended gasoil formed in step (i) at a level in the range of from 10 wt % to 80 wt %, more preferably from 20 wt % to 60 wt %, even more preferably from 30 wt % to 50 wt %, especially from 40 wt % to 50 wt %, by weight of the blended gasoil formed in step (i). The presence of a large quantity of GTL gasoil in the blended gasoil formed in step (i) means that the gravimetric energy density will be high which is expected to be beneficial for power and fuel economy.

In the process of the present invention the petroleum-derived gasoil is preferably present in the blended gasoil formed in step (i) at a level in the range of from 10 wt % to 90 wt %, more preferably from 20 wt % to 70 wt %, even more preferably from 40 wt % to 60 wt %, especially from 50 wt % to 60 wt %, by weight of the blended gasoil formed in step (i).

Preferably, the blended gasoil formed in step (i) has a kinematic viscosity at 40° C. of at least 3 mm$^2$/s, more preferably at least 3.5 mm$^2$/s and even more preferably at least 4 mm$^2$/s. The high viscosity of the blend is likely to be beneficial for power.

Preferably, the blended gasoil formed in step (i) has a density at 15° C. in the range of from 830 g/cm$^3$ to 845 g/cm$^3$, more preferably from 835 g/cm$^3$ to 845 g/cm$^3$, even more preferably from 840 g/cm$^3$ to 845 g/cm$^3$. The density of the blended gasoil formed in step (i) is towards the upper end of the density allowed in the EN590 specification, which will be beneficial (or at least not detrimental compared to the market) for power and fuel economy (FE).

Preferably the blended gasoil formed in step (i) has a cetane number of 51 or higher, more preferably 55 or higher, even more preferably 60 or higher. The high cetane of the blended gasoil is likely to be beneficial for fuel economy.

In the process of the present invention the blended gasoil produced in step (i) is mixed with a diesel base fuel preferably in a weight ratio of from 1:100 to 100:1, more preferably in a weight ratio of from 10:90 to 30:70.

The diesel fuel composition prepared according to the process of the present invention preferably has a density in the range from 0.820 g/cm$^3$ to 0.845 g/cm$^3$, more preferably in the range from 0.830 g/cm$^3$ to 0.845 g/cm$^3$, even more preferably in the range from 835 g/cm$^3$ to 845 g/cm$^3$. The diesel fuel composition prepared according to the process of the present invention preferably has a viscosity at 40° C. in the range from 3 mm$^2$/s to 4 mm$^2$/s, more preferably in the range from 3.5 mm$^2$/s to 4 mm$^2$/s.

Suitably, the diesel fuel composition herein has a cetane number of 51 or more, 53 or more, 55 or more, or 60 or more.

In accordance with the present invention, the cetane number of a fuel composition or fuel blend may be determined in any known manner, for instance using the standard test procedure ASTM D613 (ISO 5165, IP 41) which provides a so-called "measured" cetane number obtained under engine running conditions. More preferably the cetane number may be determined using the more recent and accurate "ignition quality test" (IQT; ASTM D6890, IP 498), which provides a "derived" cetane number based on the time delay between injection and combustion of a fuel sample introduced into a constant volume combustion chamber. This relatively rapid technique can be used on laboratory scale (ca 100 ml) samples of a range of different fuels.

Alternatively the cetane number or derived ignition quality of a fuel can be tested using a Combustion Research Unit (CRU) obtained from Fueltech Solutions AS/Norway. Fuels were injected into a constant volume combustion chamber preconditioned as set conditions.

Alternatively, cetane number may be measured by near infrared spectroscopy (NIR), as for example described in U.S. Pat. No. 5,349,188. This method may be preferred in a refinery environment as it can be less cumbersome than for instance ASTM D613. NIR measurements make use of a correlation between the measured spectrum and the actual cetane number of a sample. An underlying model is prepared by correlating the known cetane numbers of a variety of fuel samples with their near infrared spectral data.

The engine in which the diesel fuel composition herein is used may be any appropriate engine. Thus, where the fuel is a diesel or biodiesel fuel composition, the engine is a diesel or compression ignition engine. Likewise, any type of diesel engine may be used, such as a turbo charged diesel engine. Similarly, the invention is applicable to an engine in any vehicle.

The blended gasoil produced in step (i) of the present invention is blended in step (ii) with a diesel diesel base fuel suitable for use in an internal combustion engine.

The diesel fuel used as the base fuel herein includes diesel fuels for use in automotive compression ignition engines, as well as in other types of engine such as for example off road, marine, railroad and stationary engines. The diesel fuel used as the base fuel in the diesel fuel composition herein may conveniently also be referred to as 'diesel base fuel'.

The diesel base fuel may itself comprise a mixture of two or more different diesel fuel components, and/or be additivated as described below.

Such diesel fuels will contain one or more base fuels which may typically comprise liquid hydrocarbon middle distillate gasoil(s), for instance petroleum derived gasoils other than the petroleum derived gasoil described hereinabove which is derived from naphthenic high density petroleum crude oil. Such fuels will typically have boiling points within the usual diesel range of 150 to 400° C., depending on grade and use. They will typically have a density from 750 to 1000 kg/m$^3$, preferably from 780 to 860 kg/m$^3$, at 15° C. (e.g. ASTM D4502 or IP 365) and a cetane number (ASTM D613) of from 35 to 120, more preferably from 40 to 85. They will typically have an initial boiling point in the range 150 to 230° C. and a final boiling point in the range 290 to 400° C. Their kinematic viscosity at 40° C. (ASTM D445) might suitably be from 1.2 to 4.5 mm$^2$/s.

An example of a petroleum derived gasoil is a Swedish Class 1 base fuel, which will have a density from 800 to 820 kg/m$^3$ at 15° C. (SS-EN ISO 3675, SS-EN ISO 12185), a T95 of 320° C. or less (SS-EN ISO 3405) and a kinematic viscosity at 40° C. (SS-EN ISO 3104) from 1.4 to 4.0 mm$^2$/s, as defined by the Swedish national specification EC1.

Other diesel fuel components for use herein include the so-called "biofuels" which derive from biological materials. Examples include fatty acid alkyl esters (FAAE). Examples of such components can be found in WO2008/135602.

The diesel base fuel may itself be additivated (additive-containing) or unadditivated (additive-free). If additivated, e.g. at the refinery, it will contain minor amounts of one or more additives selected for example from anti-static agents, pipeline drag reducers, flow improvers (e.g. ethylene/vinyl acetate copolymers or acrylate/maleic anhydride copolymers), lubricity additives, antioxidants and wax anti-settling agents, and the like. In the diesel base fuel is unadditivated (additive-free), additive components or additive packages, such as those described herein, may still be added to the diesel fuel composition during or after the process for preparing the diesel fuel compositions. In a preferred embodiment, the process of the present invention comprises an additional step (iii) of adding an additive package or additive component to the diesel fuel composition.

Detergent-containing diesel fuel additives are known and commercially available. Such additives may be added to diesel fuels at levels intended to reduce, remove, or slow the build-up of engine deposits.

Examples of detergents suitable for use as diesel fuel additives for the present purpose include polyolefin substituted succinimides or succinamides of polyamines, for instance polyisobutylene succinimides or polyisobutylene amine succinamides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

Other examples of detergents suitable for use in diesel fuel additives for the present purpose include compounds having at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties; and/or (A9) moieties obtained by Mannich reaction of substituted phenols with aldehydes and mono- or polyamines.

Other detergents suitable for use in diesel fuel additives for the present purpose include quaternary ammonium salts such as those disclosed in US2012/0102826, US2012/0010112, WO2011/149799, WO2011/110860, WO2011/095819 and WO2006/135881.

The diesel fuel additive mixture may contain other components in addition to the detergent. Examples are lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide, those peroxide compounds disclosed in WO96/03397 and WO99/32584 and those ignition improvers disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; antioxidants (e.g. phenolics such as 2,6-di-tert-butylphenol, or phenylenediamines such as N,N'-di-sec-butyl-p-phenylenediamine); metal deactivators; combustion improvers; static dissipator additives; cold flow improvers; organic sunscreen compounds and/or UV filter compounds, and wax anti-settling agents.

The diesel fuel additive mixture may contain a lubricity enhancer, especially when the diesel fuel composition has a low (e.g. 500 ppmw or less) sulphur content. In the additivated diesel fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the diesel fuel composition to contain an anti-foaming agent, more preferably in combination with an anti-rust agent and/or a corrosion inhibitor and/or a lubricity enhancing additive.

Unless otherwise stated, the (active matter) concentration of each such optional additive component in the additivated diesel fuel composition is preferably up to 10000 ppmw, more preferably in the range from 0.1 to 1000 ppmw, advantageously from 0.1 to 300 ppmw, such as from 0.1 to 150 ppmw.

The (active matter) concentration of any dehazer in the diesel fuel composition will preferably be in the range from 0.1 to 20 ppmw, more preferably from 1 to 15 ppmw, still more preferably from 1 to 10 ppmw, and especially from 1 to 5 ppmw. The (active matter) concentration of any ignition improver (e.g. 2-EHN) present will preferably be 2600 ppmw or less, more preferably 2000 ppmw or less, even more preferably 300 to 1500 ppmw. The (active matter) concentration of any detergent in the diesel fuel composition will preferably be in the range from 5 to 1500 ppmw, more preferably from 10 to 750 ppmw, most preferably from 20 to 500 ppmw.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the diesel fuel composition may be suitably between 0 and 10000 ppmw and preferably below 5000 ppmw.

In the above, amounts (concentrations, % vol, ppmw, % wt) of components are of active matter, i.e. exclusive of volatile solvents/diluent materials.

The present invention will be further understood from the following examples. Unless otherwise stated, all amounts and concentrations disclosed in the examples are based on volume of the fully formulated diesel fuel composition.

EXAMPLES

A 3:2 volume blend of hydrotreated gasoil from West African (WAF) crude with GTL gasoil was prepared. The hydrotreated gasoil from West African crude (WAF gasoil) and the GTL gasoil used to prepare this blend had the properties shown in Table 1. This blend can be combined with diesel base fuel in a volume ratio of 5:3 to provide a diesel fuel composition having the properties shown in Table 1 below.

TABLE 1

| Gasoil or Gasoil Blend: | | | GTL | WAF | WAF gasoil + GTL gasoil + diesel base |
|---|---|---|---|---|---|
| Property | Unit | Method | Gasoil | Gasoil | fuel |
| Density @ 15° C. | $kg/m^3$ | DIN EN ISO 12185 | 778.2 | 874.0 | 835.1 |
| Viscosity @ 40° C. | $mm^2/s$ | DIN EN ISO 3104 | 2.742 | 4.605 | 3.384 |
| Flash Point | ° C. | DIN EN ISO 2719 | 83.0 | 71.0 | 77.0 |

TABLE 1-continued

| Gasoil or Gasoil Blend: | | | GTL | WAF | WAF gasoil + GTL gasoil + diesel base |
|---|---|---|---|---|---|
| Property | Unit | Method | Gasoil | Gasoil | fuel |
| Rancimat Oxidation Stability | h | DIN EN 15751 | 11.08 | >48 | >48 |
| CID Cetane | — | ASTM D 7668 | 86.3 | 51.2 | 61.8 |
| Sim Dist | ° C. | DIN EN 15199-1 | | | |
| | IBP | | 144.1 | 111.3 | 123.1 |
| | 1% m/m | | 151.2 | 139.3 | 143.7 |
| | 2% m/m | | 166.8 | 172.2 | 165.9 |
| | 3% m/m | | 173.3 | 189.1 | 174.1 |
| | 4% m/m | | 174.1 | 199.9 | 186.0 |
| | 5% m/m | | 182.8 | 208.7 | 192.8 |
| | 10% m/m | | 195.8 | 232.0 | 215.2 |
| | 20% m/m | | 225.2 | 252.9 | 241.1 |
| | 30% m/m | | 245.1 | 266.8 | 256.8 |
| | 40% m/m | | 263.3 | 280.2 | 270.5 |
| | 50% m/m | | 281.2 | 294.1 | 286.2 |
| | 60% m/m | | 299.6 | 304.8 | 301.0 |
| | 70% m/m | | 316.7 | 319.1 | 315.1 |
| | 80% m/m | | 334.8 | 336.9 | 330.8 |
| | 90% m/m | | 354.4 | 362.9 | 354.8 |
| | 95% m/m | | 365.9 | 385.3 | 372.2 |
| | 96% m/m | | 368.7 | 391.6 | 378.0 |
| | 97% m/m | | 372.4 | 401.1 | 384.2 |
| | 98% m/m | | 376.8 | 411.8 | 393.2 |
| | 99% m/m | | 383.1 | 427.5 | 409.6 |
| | FBP | | 388.3 | 438.1 | 422.0 |

The properties shown in Table 1 are highly beneficial for differentiated diesel fuels.

The density of the WAF gasoil/GTL gasoil blend was towards the upper end of the density allowed in the EN590 specification which is beneficial (or at least not detrimental) for power and fuel economy. In addition, the presence of a large quantity of GTL gasoil in the WAF gasoil/GTL gasoil blend means that the gravimetric energy density is high, which is beneficial for power and fuel economy benefits. The high viscosity of the WAF gasoil/GTL gasoil blend is also beneficial for power (WAF hydrotreated gasoil is highly naphthenic). Furthermore, the high cetane of the blend is beneficial for Fuel Economy.

The WAF gasoil/GTL gasoil blend is itself EN590 compliant and so can be labelled as automotive gasoil in its own right for regulatory purposes before it is blended in step (ii) of the process of the present invention with a diesel base fuel. This means that it is much easier to transport the gasoil blend produced in step (i) before it is blended in step (ii) with diesel base fuel.

That which is claimed is:

1. A process for preparing a diesel fuel composition comprising the steps of:

(i) blending a Fischer-Tropsch derived gasoil with a petroleum derived gasoil to form a blended gasoil wherein the blended gasoil has maximum density of 845 $kg/m^3$, wherein the Fischer-Tropsch derived gasoil has a density of 0.8 $g/cm^3$ or less at 15° C. and wherein the petroleum derived gasoil is derived from naphthenic high density petroleum crude oil and has a density of 0.84 $g/cm^3$ or greater at 15° C. and a naphthenics content of 50 wt % or greater, wherein the petroleum-derived gasoil is present in the blended gasoil formed in step (i) at a level in the range from 50 wt % to 60 wt %, by weight of the blended gasoil formed in step (i); and (ii) mixing the blended gasoil produced in step (i) with a diesel base fuel to form a diesel fuel composition, wherein the diesel base fuel is a diesel base fuel having a maximum density of 845 kg/m$^3$, wherein the diesel fuel composition has a density at 15° C. in the range from 0.820 g/cm$^3$ to 0.845 g/cm$^3$.

2. The process according to claim 1 wherein the petroleum derived gasoil has a density of 0.85 g/cm$^3$ or greater.

3. The process according to claim 1 wherein the Fischer-Tropsch derived gasoil is present at a level in the range of from 10 wt % to 50 wt %, by weight of the blended gasoil formed in step (i).

4. The process according to claim 1 wherein the kinematic viscosity at 40° C. of the blended gasoil formed in step (i) is at least 3 mm$^2$/s.

5. The process according to claim 1 wherein the density at 15° C. of the blended gasoil formed in step (i) is in the range of from 830 g/cm$^3$ to 845 g/cm$^3$.

6. The process according to claim 1 wherein the blended gasoil formed in step (i) has a cetane number of 60 or higher.

7. The process according to claim 1 wherein the Fischer-Tropsch derived gasoil is present in the blended gasoil formed in step (i) at a level in the range of from 40 wt % to 50 wt %, by weight of the blended gasoil formed in step (i).

* * * * *